United States Patent [19]

Lautenschläger

[11] Patent Number: 4,810,045

[45] Date of Patent: Mar. 7, 1989

[54] FITTING FOR THE ADJUSTABLE MOUNTING OF THE RUNNER OF A DRAWER SLIDE

[75] Inventor: Reinhard Lautenschläger, Reinheim, Fed. Rep. of Germany

[73] Assignee: Karl Lautenschläger GmbH & Co. KG, Reinheim, Fed. Rep. of Germany

[21] Appl. No.: 99,543

[22] Filed: Sep. 22, 1987

[30] Foreign Application Priority Data

Sep. 24, 1986 [DE] Fed. Rep. of Germany ..... 3632442

[51] Int. Cl.[4] ..... A47B 88/00

[52] U.S. Cl. ..... 312/341 R; 312/347; 312/330 R

[58] Field of Search ..... 312/330, 341 R, 341 NR, 312/342, 343, 346, 347

[56] References Cited

U.S. PATENT DOCUMENTS

| | | | |
|---|---|---|---|
| 3,328,107 | 6/1967 | Gutner | 312/347 |
| 3,377,115 | 4/1968 | Hansen et al. | 312/330 R |
| 4,475,778 | 10/1984 | Stark | 312/341 NR |
| 4,671,581 | 6/1987 | Faust et al. | 312/330 R |

*Primary Examiner*—Joseph Falk

[57] ABSTRACT

Fitting for holding the front-drawer end of the runner of a drawer slide. The fitting has a runner holding clip which can be fastened behind the drawer front under the bottom of the corner of the drawer and grips the end of the runner between two resilient legs. The runner holding clip is made integral with a corner body which in turn is integral with a mounting arm which can be fastened to the inside face of the drawer front. The area where the runner clip joins the corner body, and the area where the corner body joins the mounting arm, are made so as to be resiliently deformable, and a perpendicular threaded bore is provided in the corner body, through which the threaded shaft of an adjusting screw can be driven whose free end is in contact with the underside of the drawer bottom.

5 Claims, 3 Drawing Sheets

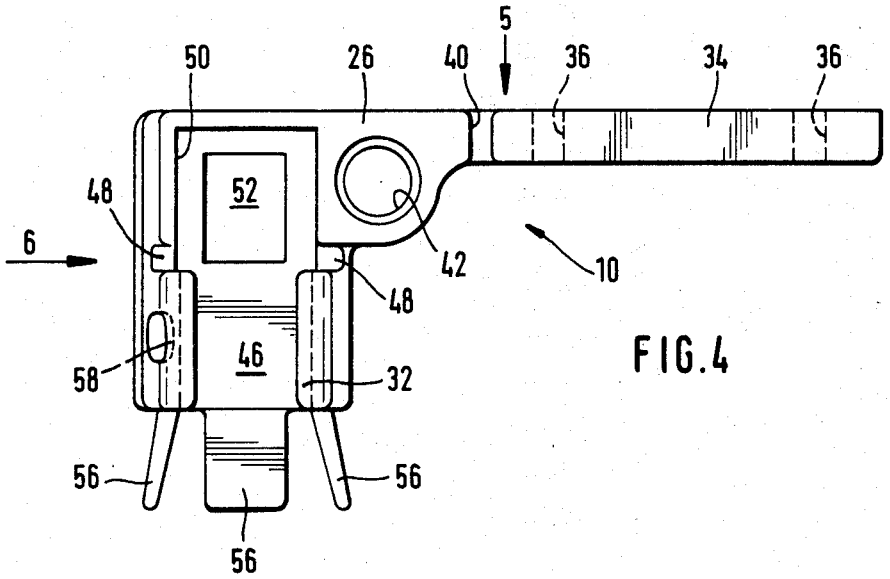
FIG.4
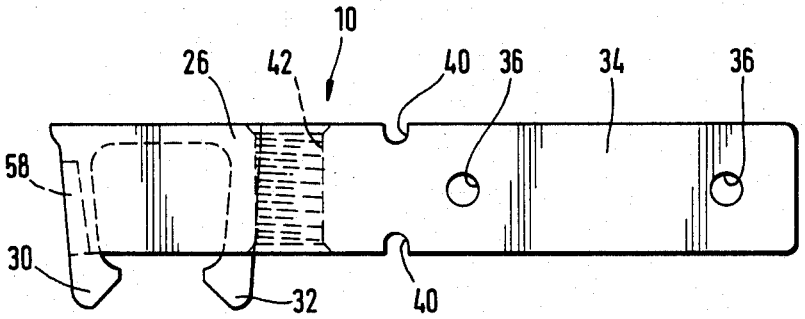
FIG.5
FIG.6
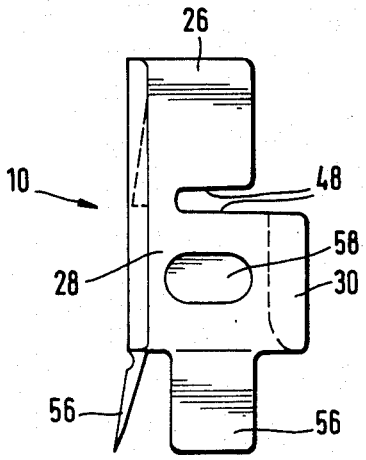

FITTING FOR THE ADJUSTABLE MOUNTING OF THE RUNNER OF A DRAWER SLIDE

BACKGROUND OF THE INVENTION

The invention relates to a fitting for mounting the drawer-face front end of the runner of a drawer slide. Such a fitting has a runner clip which can be fastened behind the drawer facing, underneath the drawer bottom, in the front corner area, and the runner clip has two legs which grip the opposite side surfaces of the runner in the manner of a clip.

Hardware fittings of this kind, which hold the front end of the runner of a drawer slide between the legs of a runner clip fixedly fastened to the drawer have the advantage that the runner can easily be snapped out of the clip in case of necessity, and on the other hand it can easily be introduced again into the clip. For this purpose the legs of the clip can be provided with ear-like projections having ramps to facilitate the insertion of the front end of the runner. Fittings of this kind are therefore also preferred for fastening the front ends of tubular runners to the bottoms of drawers. As long as the drawers are provided with front facings superimposed separately on the front wall of the drawer, and these facings are adjustable relative to the front wall for alignment with the facings of adjacent drawers and/or the cabinet side walls or even the top of the cabinet, there is no difficulty in aligning the facings of the drawers such that, when the drawers are closed, they will be in an aesthetically satisfactory precise alignment with one another and with the cabinet walls. In recent times, however, the providing of separate drawer facings on drawer fronts has been abandoned, since the front itself is the facing. Any adjustment relative to the drawer is then, of course, no longer possible. Inaccuracies in the assembly of the drawer slides, or also any racking of the cabinet carcase or of the drawers, are then manifested by a misalignment of the drawer front, which is now simultaneously the facing, relative to adjacent drawers or to the cabinet walls, which results in an unattractive appearance when, for example, the gap between drawers situated one above the other varies in width. In the most unfavorable case such racking can even cause the facings of adjacent drawers to overlap, and then one of the two drawers can no longer be closed all the way.

It is therefore the aim of the invention to create a fitting for mounting the front end of the runners of drawer slides, which will permit a shifting of the position of the front end of the runners relative to the corresponding drawer, and thus to the drawer facing, in the vertical direction, and preferably also in the transverse direction, and thus make it possible to align drawer fronts with one another and with the carcase walls.

Setting out from a hardware fitting of the kind described above, this aim is achieved according to the invention by the fact that the runner holding clip is integral with a corner body which in turn is integral with a mounting arm which can be fastened to the inside face of the drawer front; that the area of the junction between the runner holding clip and the corner body and/or the area of the junction between the corner body and the mounting arm are made resiliently deformable, and that in the corner body a perpendicular threaded bore is provided through which the threaded shaft of an adjusting screw can be driven whose free end is pressed against the underside of the drawer bottom. By turning the adjusting screw in or out of the threaded bore, the corner body can be forced away from or let come closer to the bottom of the drawer in the vertical direction. This permits an adjustment of the drawer as a whole and thus also of its front relative to the drawer slide. Thus, it is also possible to perform an alignment of the drawer front in a precisely horizontal position by an adjustment of a fitting on only one side of the drawer, or a contrary adjustment of the fittings holding the runners on the drawer. The resiliently deformable configuration of the junction between the corner body and the mounting arm prevents any twisting of the runner due to the adjusting procedure, which otherwise could make the drawer slide difficult to operate.

In a preferred embodiment of the invention, the free end of an adjusting screw driven through a threaded bore in the drawer sidewall can be brought into engagement with the clip leg pressing against the side of the runner facing the drawer sidewall. By driving this adjusting screw in or out, the runner holding clip can be adjusted with resilient flexing at the junctions relative to the drawer sidewall, and thus transversely of its front wall. The adjusting screw driven through the drawer sidewall therefore permits the desired transverse alignment of the drawer front.

In the surface of the clip leg facing the drawer sidewall it is desirable to provide a vertically disposed, groove-like recess with a closed bottom, which is engaged by the free front end of the adjusting screw. The adjusting screw therefore presses against the bottom of this groove-like recess, while deflection of the clip leg and hence of the holding head at right angles to the vertical, groove-like recess is prevented by the engagement of the free front end of the adjusting screw.

At its bottom end the groove-like recess is preferably stopped, so that this stopped end forms an abutment which can engage the free front end of the adjusting screw engaged in the groove in the case of a change in the vertical level, in order thus to limit the adjustment in the vertical direction by means of the adjusting screw passing through the corner body.

The fitting is preferably made entirely from a resiliently flexible plastic, the area where the runner clip joins the corner body and the area where the corner body joins the mounting arm are made flexible by reducing the material thickness in these areas.

BRIEF DESCRIPTION OF THE DRAWING

The invention will be further explained in the description that follows of an embodiment in conjunction with the drawing, wherein:

FIG. 4 is a bottom view of the fitting according to the invention on a larger scale than in FIGS. 1 to 3, FIG. 5 is a view, partially in phantom, of the fitting as seen in the direction of the arrow 5 in FIG. 4, and FIG. 6 is a view, partially in phantom, of the fitting as seen in the direction of the arrow 6 in FIG. 4.

Figure 2:
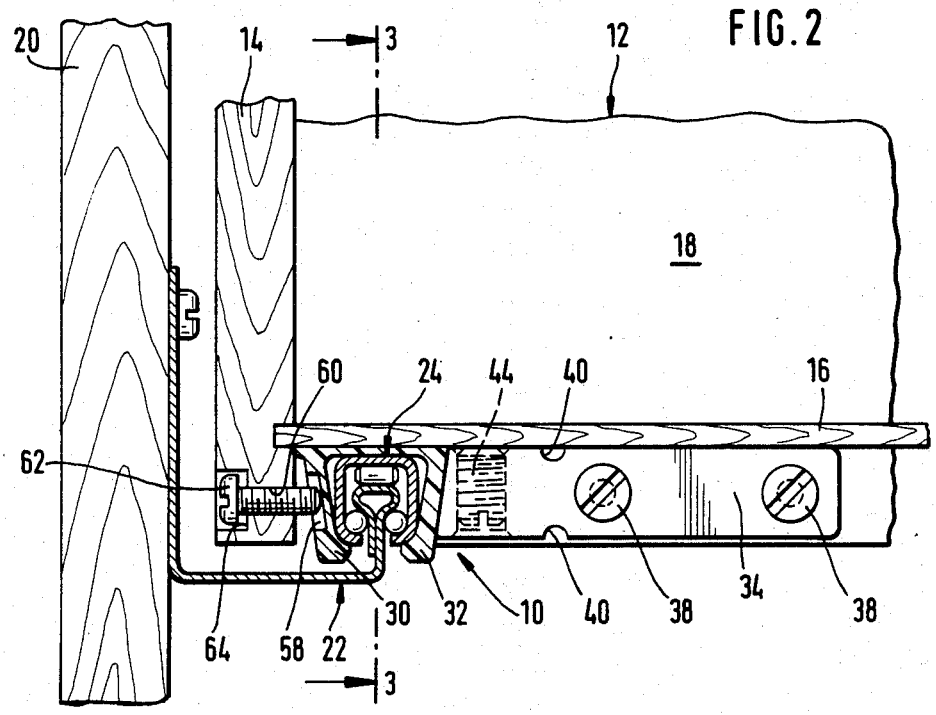
FIG. 2 is a cross section taken through the drawer corner area shown in FIG. 1 in a plane running approximately centrally through the runner holding clip, but as seen from the interior of the cabinet toward the back of the front wall of the drawer.

The drawer slide fitting according to the invention, designated as a whole by the number 10, and represented separately in FIGS. 4 to 6, is shown in the installed state at the front corner area of a drawer 12 of which sections can be seen of a side wall 14, of the drawer bottom 16 and of the drawer front 18 which simultaneously forms the front wall of the drawer. Also, the adjacent section of the side wall 20 of the corresponding cabinet carcase is represented, on whose inside surface facing the drawer the slide rail 22 is shown (FIG. 2), of the drawer slide holding the drawer on one side to enable it to be opened. The corresponding runner 24 in the form of a hollow tube slotted at the bottom runs alongside and parallel to the drawer side wall 14 under the drawer bottom 16, its front end being held in the fitting 10, while its rearward end, which is not shown, may be fastened by means of a conventional fitting in the area of the drawer back wall (also not shown).

Figure 1:
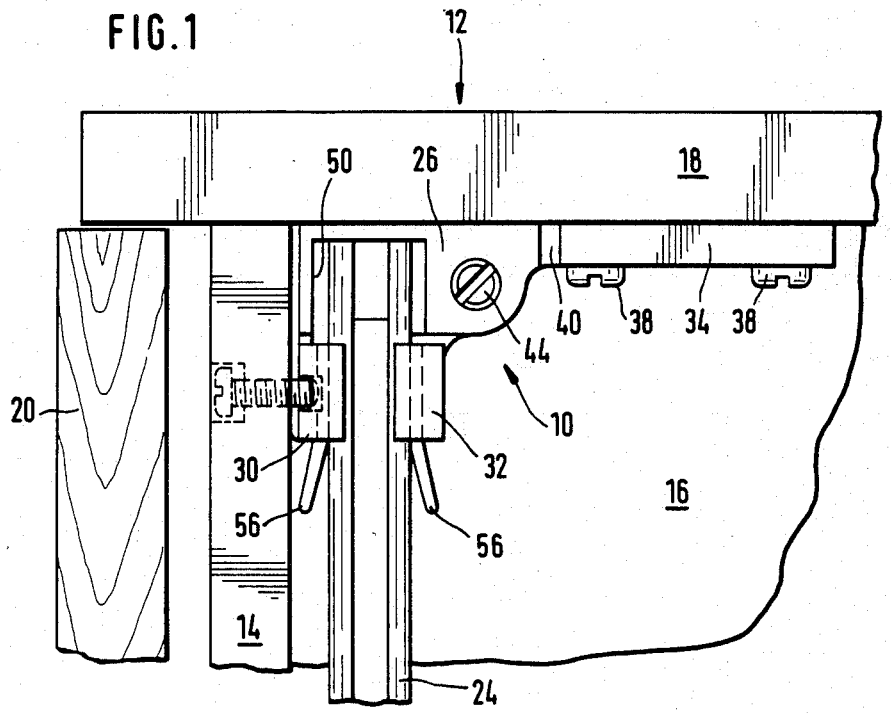
FIG. 1 is a bottom view of the front corner area of a drawer equipped with the fitting provided for the drawer slide in accordance with the invention.

The fitting 10 for mounting the runner 24, which fitting in this special case is a body made in one piece from a resiliently flexible plastic, has, as it can be seen especially in FIG. 1 and in FIG. 4 showing the piece separately on an enlarged scale, the shape, both in a bottom view and accordingly also in a top view, of an angle with a corner body 26, from which a runner holding clip 28 projects on one side, parallel to the side wall 14, the holding clip 28 having two resilient legs 30 and 32 gripping the runner 24 between them at the forward part of the runner, and on the other side, at right angles to the runner holding clip, an elongated mounting arm 34 projects having two bores 36 for mounting screws 38 whereby the mounting arm 34 is screwed onto the inside surface of the drawer front 18. In the area of the transition between the mounting arm 34 and the corner body 26 there are semicircular notches 40 in the upper and lower edge in this case, which reduce the cross section of the junction between the corner body and the mounting arm and thus make it flexible.

In the corner body 26 there is provided a perpendicular threaded bore 42 in which the threaded shaft of an adjusting screw 44 can be driven whose free end can press against the underside of the drawer bottom 16. By driving the adjusting screw 44 represented as a threaded spindle in FIGS. 1 and 2, the corner body can be pressed away from the underside of the bottom, thereby deforming the flexible transition section defined by the notches 40. The corner body 26 and thus the runner holding clip 28 on the corner body are lifted away from the underside of the drawer bottom 16 by the driving in of the adjusting screw 44 or, in another sense, the drawer bottom rises with respect to the corner body and the runner holding clip, which means that the drawer 12, and thus also its front 18, is displaced in the upward direction.

By backing out the adjusting screw 44, the drawer can be lowered again in the area of the fitting until the drawer bottom 16 is in contact with the confronting surface of the corner body.

Figure 3:
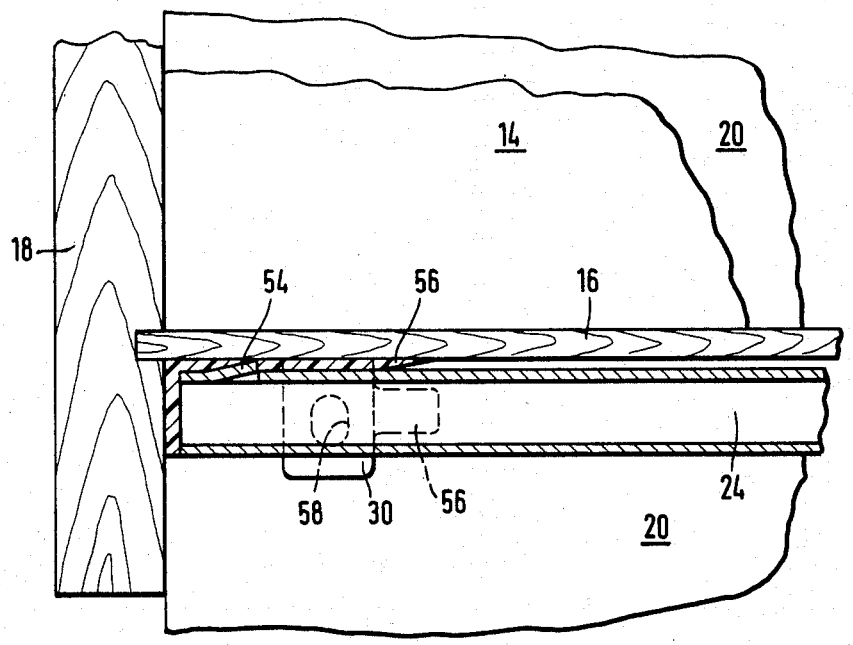
FIG. 3 is a cross section seen in the direction of the arrows 3—3 in FIG. 2.

The runner holding clip 28 consists virtually of a bottom plate 46 joined on the drawer bottom side to the corner body 26, and from this bottom plate project the two resilient clip legs 30 and 32 cut free by slots 48 from the corner body. The recess formed between the clips for the runner 24 is prolonged in the form of an opening 50 in the corner body 26 which accommodates the free end of the runner with lateral clearance. In the bottom of the opening 50 there is provided a recess or even a window 52 on whose transverse edge facing the back wall of the drawer a slanting tongue 54 cut free and pressed out (FIG. 3) is locked and thus secures the runner between the clip legs 30 and 32 against extraction. Disassembly of the end portion of the runners 24 at the drawer front is nevertheless possible by vertically snapping out the runner end, accompanied by the spreading apart of the clip legs 30 and 32. The installation of the runner 24 in the fitting 10 is performed on the other hand by pushing the runner holding clip onto the front end of the runner; for this purpose guide ears 56 are set at an angle on the two clips 30 and 32 and on the bottom plate 46 such that the front end of the runner 24, which is to be pushed between the clips 30 and 32, is automatically guided to the correct position. When the runner 24 is installed in the fitting 10 its front end is therefore pushed between the clip legs 30 and 32 into the opening 50 until the tongue 54 snaps behind the transverse edge of the recess or window 52 facing the back wall of the cabinet.

In the clip leg 30 adjacent to the drawer sidewall 14 there is provided a perpendicularly disposed, groove-like recess 58 which does not, however, extend all the way through the clip leg 30. On the bottom of the recess 58 rests the free front end of the threaded shaft of an adjusting screw 62 driven through a horizontal tap 60 in the drawer sidewall 14. The threaded shaft, therefore, cannot protrude into the interstice between the clips 30 and 32, so that the adjusting screw 60 will not interfere with the installation of the runner when it is pushed into the runner holding clip. By rotating the head of the adjusting screw in a countersink 64 of the threaded bore 60 in the driving direction, the clip 30 and thus the entire runner holding clip 28 can be forced away from the drawer sidewall 14 with resilient deformation of the junction between the corner body and the mounting arm and/or of the area where the mounting head meets the corner body. In a reaction to this, therefore, the drawer 12 shifts in the cabinet carcase, and with it also its front 18, in the transverse direction opposite the direction of the driving in of the adjusting screw 62. In addition to the height adjustment of the drawer front 18 by turning the adjusting screw 44, therefore, the desired cross adjustment can also be accomplished by turning the adjusting screw 62, so that in any case the drawer front 18 can be aligned precisely with the fronts of adjacent drawers or adjacent cabinet walls. Since the groove-like recess 58 is stopped at its bottom end, it simultaneously forms, in cooperation with the front end of the adjusting screw 62, a stop for limiting the vertical adjustment.

I claim:

1. In a furniture cabinet having a drawer with a bottom, a side wall and a front wall, both walls extending downwardly below the bottom; and a drawer slide extending substantially parallel to said side wall and having a runner with a front end adjacent said front wall, said front end having two vertical side surfaces: a one-piece unitary fitting of a resiliently flexible plastic material, said fitting comprising: a corner body, a runner holding clip having two clip legs respectively positively gripping said two vertical side surfaces, joining means integrally joining said holding clip to said corner body, a mounting arm, means connecting said mounting arm to an inside surface of the front wall of the drawer below the bottom, joining means integrally joining said mounting arm to said corner body, at least one of said joining means being elastically deformable, a threaded bore extending in said corner body parallel to said front wall; and an adjusting screw having a threaded shaft threaded into said threaded bore and having a free end below the bottom of the drawer; whereby upon threading of the adjusting screw against the bottom the position of the front end of the runner may be adjusted relative to the front wall of the drawer by elastic deformation of said at least one joining means.

2. A fitting according to claim 1, comprising: another adjusting screw extending through a threaded bore in said sidewall and having a free end in contact with one of said clip legs.

3. A fitting according to claim 2, wherein the clip leg has a groove-like recess which is entered by the free end of said another adjusting screw.

4. A fitting according to claim 3, wherein the groove-like recess has a closed bottom.

5. A fitting according to claim 1, wherein said means joining said corner body to said holding clip, and said means joining said mounting arm to said corner body are reduced material thickness sections of said holding clip and mounting arm, respectively.

* * * * *